US008708679B2

(12) United States Patent
Mathers

(10) Patent No.: US 8,708,679 B2
(45) Date of Patent: Apr. 29, 2014

(54) VANE PUMP FOR PUMPING HYDRAULIC FLUID

(75) Inventor: Norman Ian Mathers, Bridgeman Downs (AU)

(73) Assignee: Mathers Hudraulics Pty. Ltd., Banyo, QLD (AU)

( * ) Notice: Subject to any disclaimer, the term of this patent is extended or adjusted under 35 U.S.C. 154(b) by 865 days.

(21) Appl. No.: 12/303,224

(22) PCT Filed: Jun. 1, 2007

(86) PCT No.: PCT/AU2007/000772
§ 371 (c)(1),
(2), (4) Date: Jun. 16, 2009

(87) PCT Pub. No.: WO2007/140514
PCT Pub. Date: Dec. 13, 2007

(65) Prior Publication Data

US 2010/0028181 A1 Feb. 4, 2010

(30) Foreign Application Priority Data

Jun. 2, 2006 (AU) ..... 2006903064

(51) Int. Cl.
*F01C 1/00* (2006.01)
*F04B 17/00* (2006.01)

(52) U.S. Cl.
USPC ..... 418/269; 418/268; 417/410.3

(58) Field of Classification Search
USPC ..... 418/259, 106, 266–269; 417/80, 82
See application file for complete search history.

(56) References Cited

U.S. PATENT DOCUMENTS

| | | | | | |
|---|---|---|---|---|---|
| 2,919,651 | A | * | 1/1960 | Gardiner | 418/79 |
| 2,967,488 | A | * | 1/1961 | Gardiner | 418/81 |
| 2,982,223 | A | * | 5/1961 | Rosaen | 418/112 |
| 3,102,494 | A | * | 9/1963 | Adams | 418/268 |
| 3,223,044 | A | * | 12/1965 | Adams et al. | 418/82 |
| 3,320,897 | A | * | 5/1967 | Eickmann | 418/31 |
| 3,362,340 | A | * | 1/1968 | Adams | 418/269 |
| 3,401,641 | A | * | 9/1968 | Adams et al. | 418/268 |
| 3,421,413 | A | * | 1/1969 | Adams et al. | 418/80 |
| 3,578,888 | A | * | 5/1971 | Adams | 418/133 |
| 3,586,466 | A | * | 6/1971 | Erickson | 418/80 |

(Continued)

FOREIGN PATENT DOCUMENTS

| | | | |
|---|---|---|---|
| DE | 4 136 151 | A1 | 5/1993 |
| JP | 2002 275 979 | A | 9/2002 |
| WO | WO 2005/005782 | A1 | 1/2005 |

OTHER PUBLICATIONS

International Search Report PCT/AU2007/000772 Dated Jul. 23, 2007.

*Primary Examiner* — Charles Freay
*Assistant Examiner* — Alexander Comley
(74) *Attorney, Agent, or Firm* — Schwegman Lundberg & Woessner, P.A.

(57) ABSTRACT

A vane pump of the intravane type for pumping hydraulic fluid, wherein each vane of the pump has two intravanes and that pressurized oil is provided to one or both intravane regions when the vane is in a rise region of the pump. The pump is operated such that the pressurized oil is provided to both undervane regions when the pump is running at low speed but the pressurized oil is provided to only one of the undervane regions when of the pump is running at high speed.

12 Claims, 7 Drawing Sheets

(56) References Cited

U.S. PATENT DOCUMENTS

| | | | | | |
|---|---|---|---|---|---|
| 3,640,651 | A | * | 2/1972 | Johnson | 418/269 |
| 3,790,314 | A | * | 2/1974 | Swain et al. | 418/1 |
| 4,272,227 | A | * | 6/1981 | Woodruff | 417/440 |
| 4,354,809 | A | * | 10/1982 | Sundberg | 418/268 |
| 4,431,389 | A | * | 2/1984 | Johnson | 418/82 |
| 4,505,654 | A | * | 3/1985 | Dean et al. | 418/80 |
| 4,629,406 | A | * | 12/1986 | Tantardini | 418/268 |
| 4,913,636 | A | * | 4/1990 | Niemiec | 418/82 |
| 5,064,362 | A | * | 11/1991 | Hansen | 418/186 |
| 5,385,458 | A | * | 1/1995 | Chu | 418/255 |
| 5,733,109 | A | * | 3/1998 | Sundberg | 418/30 |
| 6,015,278 | A | * | 1/2000 | Key et al. | 418/82 |
| 6,135,742 | A | | 10/2000 | Cho | 418/173 |
| 6,817,438 | B2 | * | 11/2004 | Modrzejewski et al. | 180/429 |
| 7,083,394 | B2 | * | 8/2006 | Dalton | 417/220 |

* cited by examiner

VANE PUMP FOR PUMPING HYDRAULIC FLUID

This application is a 371 filing of International Patent Application PCT/AU2007/000772 filed Jun. 1, 2007.

FIELD OF THE INVENTION

The present invention relates to an improved vane pump.

BACKGROUND ART

Hydraulic vane pumps are used to pump hydraulic fluid in many different types of machines for different purposes. Such machines include, for instance, earth moving, industrial and agricultural machines, waste collection vehicles, fishing trawlers, cranes, and vehicle power steering systems.

Hydraulic vane pumps typically have a housing with a chamber formed therein. A rotor is rotatably mounted in the housing. The rotor is typically of generally cylindrical shape and the chamber has a shape such that one or more rise and fall regions are formed between an outer wall of the rotor and an inner wall of the chamber. In the rise regions, a relatively large space opens between the outer wall of the rotor and the inner wall of the chamber. On the leading side of the rise region, there exists a region which is substantially a dwell, although in usual practice there exists a small amount of fall. This is sometimes called a major dwell or major dwell region. The major dwell is followed by a fall region, in which the space between the outer wall of the rotor and the inner wall of the chamber decreases. The rotor normally has a number of slots and moveable vanes are mounted in the slots. As the rotor rotates, centrifugal forces cause the vanes to move to an extended position as they pass through the rise regions. As the vanes travel along the fall regions, the vanes are forced to move to a retracted position by virtue of the rotors contacting the inner wall of the chamber as they move into a region of restricted clearance between the rotor and chamber. Hydraulic fluid lubricates the vanes and the inner wall of the chamber. Outside of the rise, fall and major dwell regions, the space between the outer wall of the rotor and the inner wall of the chamber is small. In practice, this is usually a true dwell of zero vane extension and is sometimes called the minor dwell.

Hydraulic vane pumps are usually coupled to a drive, such as to a rotating output shaft of a motor or an engine and, in the absence of expensive space invasive clutches or other disconnecting means, continue to pump hydraulic fluid as long as the motor or engine continues to operate. A rotor of the pump usually has a rotational speed determined by the rotational speed of the motor or engine.

U.S. Pat. No. 3,421,413 to Adams et al describes a sliding vane pump in which hydraulic pressure is applied to each vane in order to maintain the vanes in optimum engagement with a cam surface that encircles the rotor which carries the vanes. That patent is directed towards ensuring that the vanes remain in optimum contact with the encircling cam.

U.S. Pat. No. 3,586,466 to Erickson describes a rotary hydraulic motor having a slotted rotor and a moveable vane located in each slot. The rotor is journalled in a chamber that defines three circumferentially spaced crescent-shaped pressure chamber sections. The hydraulic motor includes a valve control means and associated passages to be able to selectively control the flow of pressurised fluid to the pressure chamber sections. This allows pressurised fluid to be supplied to one, two or all three pressure chamber sections. When pressurised fluid is delivered to all three pressure chamber sections, low speed, high torque operation occurs. When pressurised fluid is delivered to two pressure chamber sections, higher speed but lower torque operation occurs. When pressurised fluid is delivered to only one pressure chamber section, even higher speed but lower torque operation of the motor occurs.

The hydraulic motor of Erickson also includes an arrangement of passages that allow pressurised fluid to impart radially outward movement to the vanes adjacent inlet passages to the pressurised chamber sections and to impart radially inward movement to the vanes adjacent outlet passages of the pressurised chamber sections. Thus, each vane is fluid pressure urged radially outwardly into sealing engagement with the concavity or concave surface of each pressurised chamber section during initial movement of the vane circumferentially across the pressurised chamber section, the vane being moved radially inwardly by fluid pressure at the circumferentially opposite end of the pressurised chamber section, to reduce the frictional load between each vane and the inner peripheral surface portions of the chamber at areas wherein there is little or no circumferential pressure applied to the vanes (see column 4, lines 55 to 72).

The entire contents of U.S. Pat. No. 3,421,413 and U.S. Pat. No. 3,586,466 are expressly incorporated herein by cross reference.

In my co-pending International Patent Application No. PCT/AU2004/000951, I describe a hydraulic machine in which the vanes can be selectively retained in a retracted position such that the hydraulic fluid is not worked, and in which the vanes can be selectively allowed to move between the retracted position and the extended position such that the hydraulic fluid is worked by the vanes. That international patent application also describes a number of venting arrangements by which pressurised hydraulic fluid under the vanes can be vented as the vanes move into and through the fall regions. The entire contents of my International Patent Application No. PCT/AU2004/000951 are herein incorporated by cross reference.

One known limit to improving the pressure and speed capability of hydraulic fluid vane pumps is the out-of-balance forces applied to the under-vane regions in the mid quadrant. In this regard, hydraulic vane pumps typically have an inlet located at the start of the rise region (if the pump has more than one rise region, it will have more than one inlet). The inlets supply low pressure hydraulic fluid (for convenience, "hydraulic fluid" will hereinafter be referred to as "oil") to the rise region. As the vanes move the oil through the rise region, into the major dwell and then into the fall region, the oil becomes pressurised. The pressurised oil leaves via outlets associated with each fall region of the pump.

It is also known that, in many hydraulic vane pumps, the under vane region is exposed to oil that has been pressurised to the outlet pressure. This assists in driving the vanes outwardly in the rise region and also ensures that balanced forces are applied to each vane in the fall regions of the pump. However, supplying pressurised oil to under the vanes can lead to out of balance forces being applied to the vanes. For example, when the vane is on the pressure (or outlet) quadrant, the vane is exposed to high pressure oil at both an outer tip of the vane and under the vane. Thus, the forces on the vane arising from the oil are in balance. However, in the suction (or inlet) quadrants, the tips of the vanes are exposed to low pressure inlet oil whilst the bottom of the vanes are exposed to high pressure oil. This causes an imbalance of pressure which acts to push the vanes outwardly. This force can exceed the limits of the pump specifications. If this happens, the vanes can be driven through the protective film of oil that should exist between the tips of the vanes and the pump chamber. If this occurs, damage to the vanes can be caused.

There have been some attempts to limit these forces, including:

(a) providing a small vane area over the suction quadrant to which the high pressure oil is directed. As the force applied by the under-vane oil is a product of the oil pressure multiplied by the area over which that pressure is applied, the force is lower in the suction quadrant. Typically, pressurised oil is applied to the full vane area at the discharge outlet;

(b) pin vane arrangements which use a pin inside a separate chamber, to which high pressure oil is directed. This high pressure oil only acts on the small pin, which will typically generate insufficient force to push the vane through the oil film in the suction quadrant.

These methods are all intended to limit the under vane force in the suction quadrant. However, as the areas under the vanes in the suction quadrants to which high pressure outlet oil is directed are reduced to increase the under pressure and speed rating of the pumps, the pumps can be unstable at lower speeds and pressures as the forces are too low to hold the vanes in stable operation.

Another solution that has been proposed is embodied in so-called intravane pumps. In intra-vane pumps, each vane is provided with a small intravane. The intravane is fitted into a region that has an upper extent located below the upper surface of the vane. This region has a lateral extent that is less than the lateral width of the vane. In the suction zone, pressurised oil is supplied to the intravane region and, due to the smaller area of the intravane region, the force applied by that pressurised oil is lower than the pressure that would be provided if the pressurised oil was supplied to the under vane region. In the outlet zone, pressurised oil is provided to the under vane region to balance the forces acting on the vane. Although this solution is quite effective at low pump speed, it has been found that the force applied by the pressurised oil can drive the vane through the protective oil film at higher pump speeds. An acceptable compromise between satisfactory operation at low pump speeds (which requires applying sufficient force to the vanes to drive them into the extended position) and satisfactory operation at higher pump speeds has been difficult to achieve in practice.

The applicant does not concede that the prior art discussed above forms part of the common general knowledge in Australia or elsewhere.

Throughout this specification, the term "comprising" and its grammatical equivalents are to be given an inclusive meaning unless the context of use indicates otherwise.

DISCLOSURE OF INVENTION

In a first aspect, the present invention provides a vane pump for pumping hydraulic fluid comprising a body having a chamber and a rotor rotatable within the chamber, the chamber and the rotor being shaped to define one or more rise, fall and dwell regions between walls of the chamber and the rotor, the rotor having a plurality of slots, each slot of the rotor having a vane located therein, each vane being moveable between a retracted position and an extended position wherein in the retracted position the vanes do not work the hydraulic fluid and in the extended position the vanes work the hydraulic fluid, one or more inlets for introducing relatively low pressure hydraulic fluid into the one or more rise regions and one or more outlets for discharging relatively high pressure hydraulic fluid from the one or more fall regions, an under vane passage extending beneath each vane, at least one flow passage for supplying pressurised hydraulic fluid to the under vane passages, each vane having at least two regions located below an upper surface of the vane, and flow passages for delivering pressurised oil to one or more of the at least two regions.

In one embodiment, the at least two regions comprises two regions. For convenience, the invention will hereinafter be described with reference to the vanes having two regions located below another surface of the vane.

In one embodiment, the pump is arranged such that pressurised oil can be delivered to one or both of the regions. Suitably, pressurised oil is delivered to the region or regions when the vane is in a rise region of the pump.

In a suitable embodiment, pressurised oil is delivered to both regions of a vane when the pump is operating at relatively low pump speeds, but delivered to only one region of a vane when the pump is operating at relatively high pump speeds.

The pressurised oil that is delivered to the region or regions may be at outlet pressure, or it may be delivered at a pressure between the inlet pressure of the pump and the outlet pressure of the pump.

Flow control means may be incorporated to pass oil to both regions of a vane when the pump is operating at low pump speed and to pass oil to only one region of a vane when the pump is operating at high pump speeds. The flow control means may comprise a control valve that is responsive to pump outlet flow, with the flow valve operating to stop the flow of oil to one of the regions of a vane at high pump speeds, or to allow the flow of oil to only one of the regions at high pump speeds.

It will be appreciated that "low pump speeds" and "high pump speeds" are used throughout this specification in a relative context and that the actual speed that constitutes a "low pump speed" or a "high pump speed" will vary from pump to pump. It will be understood that a "high pump speed" is one at which a vane may drive through the protective oil film in the suction zone or rise region of the pump if pressurised oil is fed to both regions of a vane, and a "low pump speed" is any pump speed below that level.

As an alternative, the control flow valve may be directly responsive to pump speeds. In this example, the pump may be provided with a speed sensor and the speed sensor may send an electronic signal or data signal to the control valve. The control valve may be controlled by control algorithm that switches the valve from allowing flow to both regions of a vane to allowing flow to only one region of a vane when the speed sensor detects that the pump speed has passed a predetermined threshold value.

In one embodiment of the present invention, the pump is arranged such that pressurised oil at pump outlet pressure is supplied to the undervane passage (and hence all of the undervane area of the vane is exposed to pressurised oil at outlet pressure) when the vanes are in a fall region (also known as an outlet region), and pressurised oil is supplied to one or both of the regions of a vane when the vane is in a rise region. In this embodiment, the supply of pressurised oil in the rise region (or suction region) is only to the one or both regions, which means that pressurised oil is applied to a total area that is less than the area of the underside of the vane. As the force supplied by the pressurised oil is a function of the pressure of the oil in the area to which it is applied, a lower force is applied by the pressurised oil than if the pressurised oil was applied in the rise region to the undervane passages. Thus, the force driving the vanes outwardly as the vanes enter the rise region is reduced. The force is desirably large enough to ensure satisfactory extension of the vanes in the rise region but not so large that the vanes are driven through the protective oil film on the inside of the chamber of the pump. At low pump speeds, oil is provided to both regions of a vane. At higher pump speeds, which result in increased forces being applied to the vanes to the chamber wall due to increased centripetal forces, the pump is desirably operated such that pressurised oil is supplied to only one of the regions. In this fashion, the force applied to the vanes by the pressurised oil is reduced at higher pump speeds than if pressurized oil was supplied to both regions.

In a particularly suitable embodiment of the present invention, each of the regions of a vane is also fitted with an intravane. Thus, the pump of this embodiment is an intravane pump, but it differs from known intravane pumps in that each vane has two or more intravanes, whereas known intravane pumps have only a single intravane for each vane.

The pump will suitably be provided with appropriate pick-up orifices or slots to enable pressurised oil to be fed to the appropriate locations during rotation of the pump. Such pick-ups are well known to those skilled in the art. The pick-up slots or orifices are typically provided in the backing plate or pressure plate of the pump. The pick-up slot or orifices will typically come into register with appropriate passage openings in the rotor as the rotor rotates during operation of the pump. Again, these arrangements are well known to persons skilled in the art.

In another embodiment of the present invention, each vane may comprise two vanes positioned in face-to-face relationship in each slot of the rotor. This arrangement is advantageous because the force applied between the vane and the rotor is divided between two lines of contact (with one line of contact being formed by the tip of each of the smaller vanes in the slot). In contrast, where the vane constitutes a single vane, a single line of contact bears the force between the vane tip and the inner wall of the pump chamber.

In a second aspect, the present invention provides a vane pump of the intravane type for pumping hydraulic fluid, characterised in that each vane of the pump has two intravanes and that pressurised oil is provided to one or both intravane regions when the vane is in a rise region of the pump.

In a third aspect, the present invention provides a method for operating a vane pump of the intravane type for pumping hydraulic fluid, wherein each vane has two intravanes, the method being characterised in that pressurised oil is provided to one or both intravane regions when the vane is in a rise region of the pump.

The method may further involve providing pressurised oil to both intravane regions at low pump speeds and providing pressurised oil to one intravane region at high pump speeds.

In embodiments of the present invention where each vane comprises two smaller vanes in face-to-face relationship, it will be appreciated that the smaller vanes together act to form a single vane.

DETAILED DESCRIPTION OF THE INVENTION

It will be understood that the attached drawings are provided for the purposes of illustrating preferred embodiments of the present invention. Thus, it will be understood that the present invention should not be considered to be limited solely to the features shown in the attached drawings.

Figure 1:
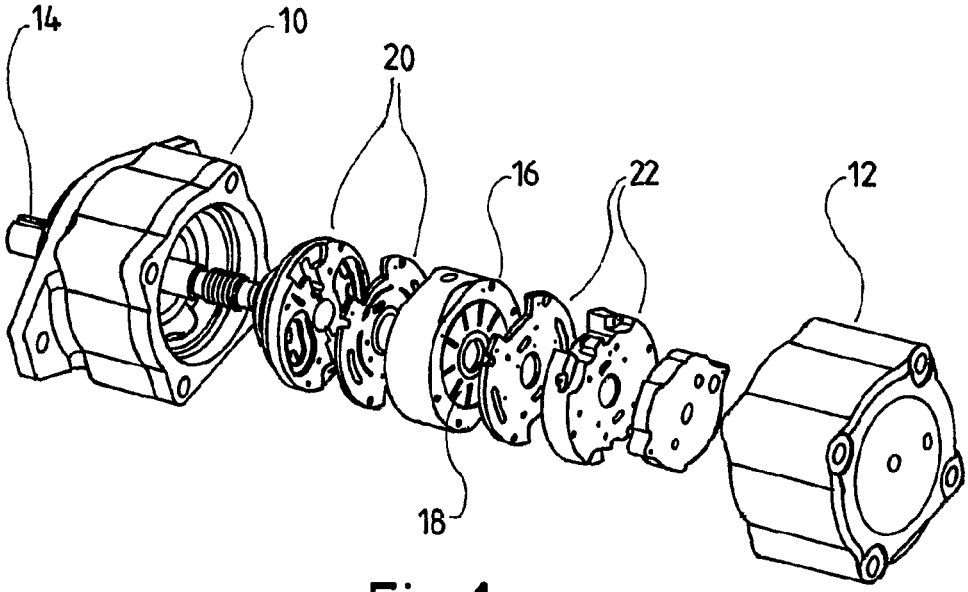
FIG. 1 shows a perspective view, apart and in line for assembly, of the various features of a vane pump for pumping hydraulic fluid.

FIG. 1 shows a schematic view of a vane pump used for pumping hydraulic fluids. The vane pump is apart and in line for assembly. The pump includes a pump housing 10 and a pump cover 12. A drive shaft 14 extends through the rear face of the pump housing 10. The pump further includes a pump body 16 that houses a rotor 18. Pump body 16 defines a chamber having a cam ring. The shape of the chamber and the generally cylindrical rotor 18 define one or more rise and fall regions formed between the outer wall of the rotor and the cam ring of the chamber. Backing plates 20 and pressure plates 22 are also provided to retain the pump body 16 and rotor 18 in place and to ensure that hydraulic fluid or oil can be fed to the inlet and outlets (more particularly, the suction inlets and discharge outlets) of the pump. The backing plates and pressure plates may also be provided with various slots and orifices that come into register with the openings of other passages formed in the rotor to thereby enable hydraulic fluid or oil to be fed to various parts of the rotor, such as the undervane passages. The slots or orifices in the backing plates and pressure plates move into and out of register with the openings in the passages in the rotor as the rotor rotates. Rotation of the rotor is caused by rotation of the drive shaft. In this regard, the drive shaft is typically splined onto the rotor.

The above construction is generally conventional.

Figure 2:
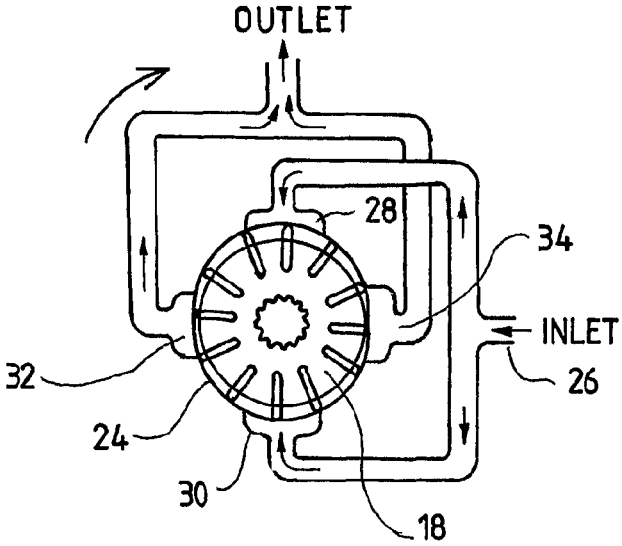
FIG. 2 shows a schematic view of the inlet and outlet chambers between the pump rotor and the cam ring.

FIG. 2 shows a schematic diagram of the inlet and outlet regions of a hydraulic vane pump. In FIG. 2, the chamber 24 of pump body 16 and rotor 18 (both from FIG. 1) are clearly shown. The eccentricity of chamber 24 is also shown. The chamber 24 and rotor 18 define between them various rise regions, full regions, major dwell regions and minor dwell regions. These regions are clearly explained in the introductory part of this specification. Inlet oil at inlet pressure is fed via inlet 26 to the suction inlets 28, 30 of the pump. The suction inlets are typically located in a rise region. The suction inlet may extend into the adjacent dwell regions.

The discharge outlets 32, 34 receive higher pressure hydraulic fluid and discharge that higher pressure fluid from the pump. The discharge outlets are typically located in the fall regions of the pump. The discharge outlets may extend into the adjacent dwell regions. Again, the operation described with reference to FIG. 2 is generally conventional.

Figure 3:
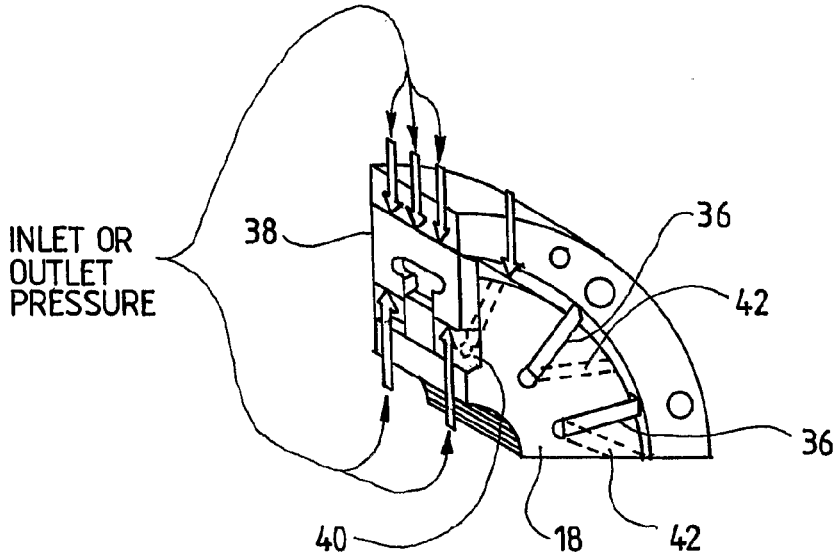
FIG. 3 is a schematic view showing one way in which pump pressure is directed to the bottom of the vanes via drilled passages opening into the undervane passages.

FIG. 3 shows a cross-section of a rotor and pump body illustrating one way in which hydraulic fluid or oil can be provided to an undervane passage in the rotor. In FIG. 3, the rotor 18 has a plurality of slots 36 formed therein. Each slot 36 is fitted with a slidable vane 38. Each slot 36 has an undervane passage 40. The rotor may also be provided with further passages 42 that provide pressurised oil to the undervane passages.

Figure 4:
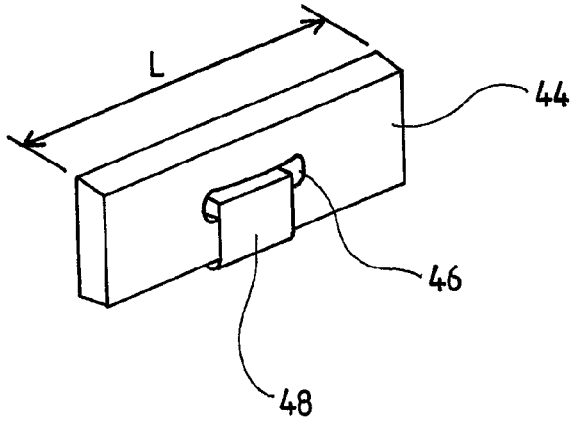
FIG. 4 is a perspective view an intravane vane using existing intravane pumps.

FIG. 4 shows an example of a vane that is used in a known intravane pump. In FIG. 4, the vane 44 is provided with a cut-out region 46. The maximum length of the cut-out region 46 is typically around one-quarter of the length L of the vane 44. A small intravane 48 fits into the opening or cut-out region 46. The vane 44 can slide relative to the intravane 48. It is also possible that the intravane 48 moves with the vane 44 as the vane 44 extends and retracts during rotation.

Figure 5:
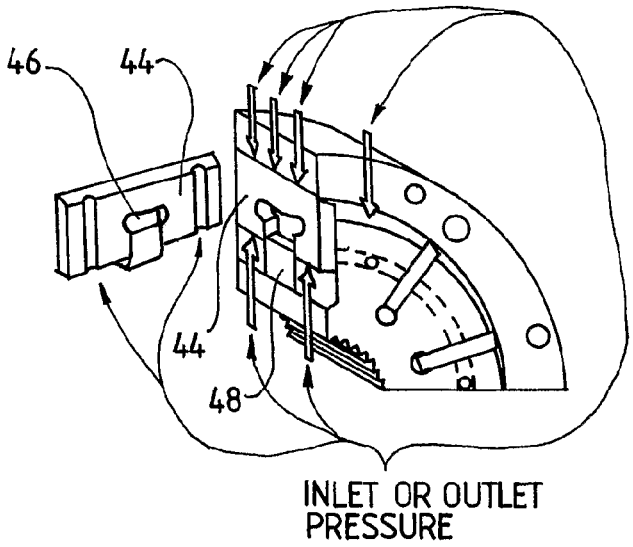
FIG. 5 shows one way in which pressurised oil can be supplied to the undervane passage of an intravane pump.

FIG. 5 provides a schematic example of how the vane 44 and the intravane 48 can move relative to each other. As shown in FIG. 5, hydraulic fluid may be provided to the cut-out region 46 in order to cause the vane 44 to extend whilst the intravane 48 remains in a retracted position. Alternatively, pressurised hydraulic fluid or oil may be provided to the undervane passage. In this case, pressurised hydraulic fluid is positioned underneath both the vane 44 and the intravane 48, thereby causing both the vane 44 and intravane 48 to extend.

Figure 6:
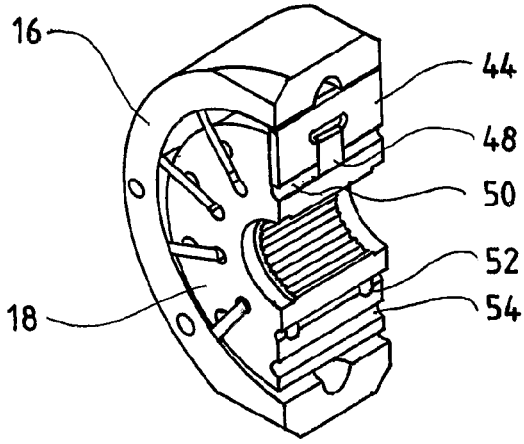
FIG. 6 shows a cross-sectional perspective view showing passages inside the rotor for supplying oil to the undervane passage and to the intravane regions, respectively.

FIG. 6 shows one way in which pressurised oil can be fed to either the undervane passage or to the intravane region 46 (as shown in FIG. 5). In FIG. 6, the pump body 16 and rotor 18 are clearly shown, as is one vane 44 and its intravane 48. The undervane passage 50 can also be clearly shown in FIG. 6.

The rotor 18 shown in FIG. 6 is also provided with a vane pressure feed passage 52 and an intravane pressure feed passage 54. These passages selectively move in to register with pressure slots or orifice pick-up points formed in the backing plates or pressure plates and pick-up pressurised hydraulic fluid when they are in register with those pick-up slots or orifices. As rotation continues, the pressure feed passages 52, 54 move out of register with the pick-up slots or orifices to thereby remove the supply of pressurised oil therefrom. Again, this will be well understood by persons skilled in the art.

A conventional intravane pump (as shown with reference to FIGS. 4 to 6) will typically operate by providing pressurised hydraulic fluid, usually at outlet pressure, to the intravane region 46, when a vane enters the rise region. The pressurised oil assists in moving the vane 44 to the extended position. Furthermore, due to the reduced length of the intravane region 46 relative to the length L of the vane 44, the force applied by the pressurised oil to push the vane 44 to the extended position is lower than if the pressurised oil had been provided to the undervane passage 50. In this regard, it will be understood that the force applied is equal to the pressure of the oil multiplied by the area at which the force is applied. When the oil is applied to the intravane region 46, the area is approximately one-quarter of the area of the undervane passage. Therefore, the force applied by applying pressurised oil to the intravane 46 is approximately one-quarter of the force that will be applied if the oil was supplied to the undervane area via the undervane passage 50.

Although conventional intravane pumps operate reliably at low speeds, as the speed of the pump increases, it is possible that the vane 44 may be driven through the protective oil film on the cam ring of the pump body 16, which has potential to cause damage to the vane and the cam ring. Embodiments of the present invention address this issue.

Figure 7:
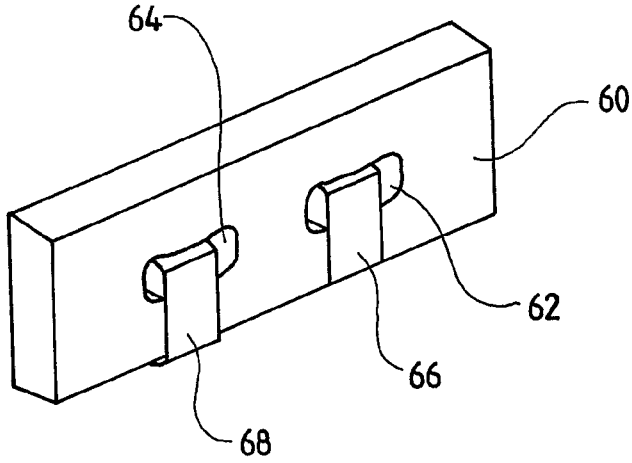
FIG. 7 is a perspective view of a double intravane vane for use in a pump for pumping hydraulic fluid in accordance with an embodiment of the present invention.

FIG. 7 shows a vane suitable for use in a pump in accordance with the present invention. The vane 60 shown in FIG. 7 includes a first cut-out region 62 and a second cut-out region 64. Cut-out region 62 is provided with an intravane 66, whilst cut-out region 64 is provided with an intravane 68. Compared to the cut-out region 46 of the conventional intravane vane shown in FIG. 4, the cut-out regions 62 and 64 individually have a smaller length than cut-out region 46. Collectively, cut-out regions 62 and 64 may have a combined total length that is generally similar to the total length of the cut-out region 46 shown in FIG. 4.

Figure 8:
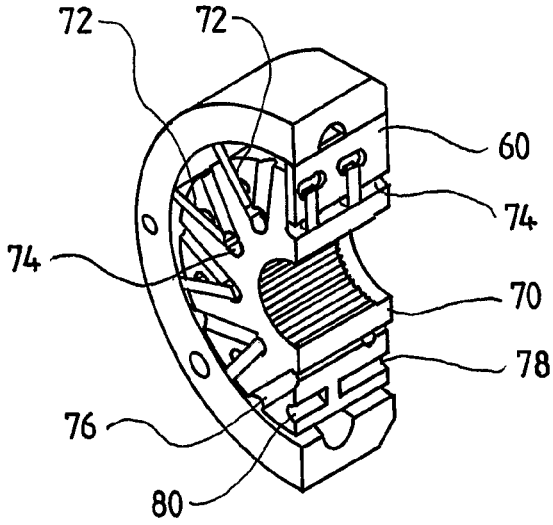
FIG. 8 shows a cross-sectional perspective view showing the various passages for supplying oil to the undervane passage and the intravane regions for an intravane pump utilising a double intravane vane as shown in FIG. 7.

FIG. 8 shows the vane 60 shown in FIG. 7 as fitted into an intravane pump. In FIG. 8, the rotor 70 is provided with a plurality of slots 72. Each slot 72 is fitted with a double intravane vane 60 as shown in FIG. 7. Each slot 72 has an undervane passage 74. The undervane passage 74 is supplied with pressurised oil via vane pressure feed passage 76. In this fashion, pressurised oil can be provided to the undervane passages. In the embodiment shown in FIG. 8, the undervane passages 74 are fed with oil that is largely at the pressure of the oil in whatever part of the pump that the vane is passing through. For example, when a vane is in the discharge zone of the pump, the oil fed to undervane passages 74 is at discharge pressure. Similarly, in the inlet or suction zone, the oil fed to the undervane passages is at inlet or suction pressure. By this fashion, the forces on the vanes 60 in the discharge zone are balanced.

In order to assist in extending the vanes from the retracted position as a vane moves into a rise region of the pump, it is desirable that pressurised oil is provided to one or both of the intravane cut-out regions 62, 64. To this end, the rotor is also provided with a first intravane pressure feed passage 78 and a second intravane feed passage 80. The first intravane feed passage 78 and the second intravane feed passage 80 move into and out of register with appropriate grooves in the backing plates and/or pressure plates. This causes pressurised fluid, suitably at discharge pressure, to be fed to the intravane pressure feed passages 78 or 80, or both.

Figure 9:
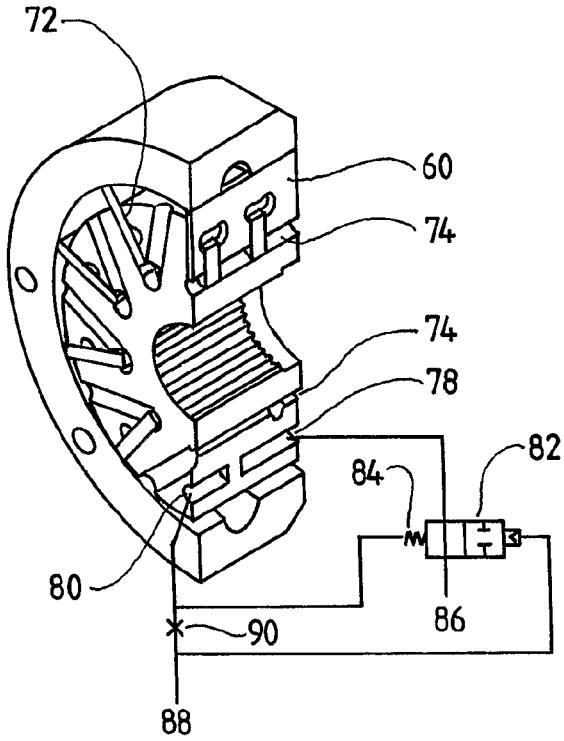
FIG. 9 shows a similar view to that shown in FIG. 8, but with details of an hydraulic circuit that may be used for supplying pressurised oil to both intravane regions of a vane at low pump speed and to only one intravane region of a vane at high pump speed.

Desirably, the intravane pump shown in FIG. 8 is arranged such that pressurised oil is fed to both intravane pressure feed passages 78 and 80 when the pump is operating at low speed and pressurised oil is fed to only one of the intravane pressure feed passages when the pump is operating at higher speed. One possible method of ensuring that this occurs is shown in FIG. 9. The apparatus shown in FIG. 9 is essentially identical to that shown in FIG. 8, and for convenience, like reference numerals will be used to refer to like parts.

The pump of FIG. 9 further includes a hydraulic circuit or fuse which includes a valve 82. Valve 82 includes a spring 84. Spring 84 has a certain force rating or spring rating and it is used to keep open flow path 86 that comes into fluid communication with intravane pressure feed passage 78 during the appropriate stages of revolution of the rotor.

The hydraulic circuit also includes flow path 88 that provides pressurised oil to intravane pressure feed passage 80.

Flow path 88 includes an orifice 90. When the pressure drop from P1 to P2 (shown in FIG. 9) reaches the value of the spring setting or spring rate, valve 82 closes to shut the flow path 86 to the intravane pressure feed passage 78. Thus, pressurised oil is no longer fed to the first cut-out region that houses intravane 66. Consequently, no force is applied through that intravane region that assists in driving the vane outwardly. However, pressurised oil is still supplied to the intravane pressure feed passage 80 and thence to the intravane region 64.

It will be appreciated that as the pump speed increases, the discharge pressure will also increase. As flow path 88 is typically fed with oil at discharge pressure, as pump speed increases, the pressure drop across orifice 90 will also increase. When this pressure drop increases to a preset value (which is set by the spring rate or spring 84 and the area on which the pressure drop acts in valve 82), the valve 82 will close. Thus, valve 82 can be preset to close at a predetermined pump speed to thereby turn off the flow of pressurised oil to the intravane region 62 at that predetermined pump speed. This reduces the force on the vane tips in the suction quadrant of the pump at higher pump speeds.

The intravane regions 62, 64 may be of the same size. Alternatively, the intravane region 62 may be of a different size to intravane region 64. With two different sizes, a three step full system can be used with appropriate valving. For example, if two different size intravanes have a width ratio of 40 to 60 is used, the following operating zones may be achieved:

- at low speeds, pressurised oil may be provided to both intravane regions. In this instance, 100% of the intravane area is fed with pressurised oil;
- at medium speeds, pressurised oil may be fed to only the larger intravane region. In this instance, 60% of the total intravane region (being the area of the larger intravane) is exposed to pressurised oil; and
- at high speeds, only the smaller intravane region may be supplied with pressurised oil. In this instance, 40% of the total area of the intravane regions (being the area of the smaller intravane) is provided with pressurised oil.

A further refinement for extreme pressures in speed is also possible by using a standard pressure regulator to regulate the pressure of the oil being fed to the intravane pressure feed passages. The pressure regulator may be as described in my recently filed International Patent Application No: PCT/AU2006/000623, the entire contents of which are herein incorporated by cross reference.

Figure 10:
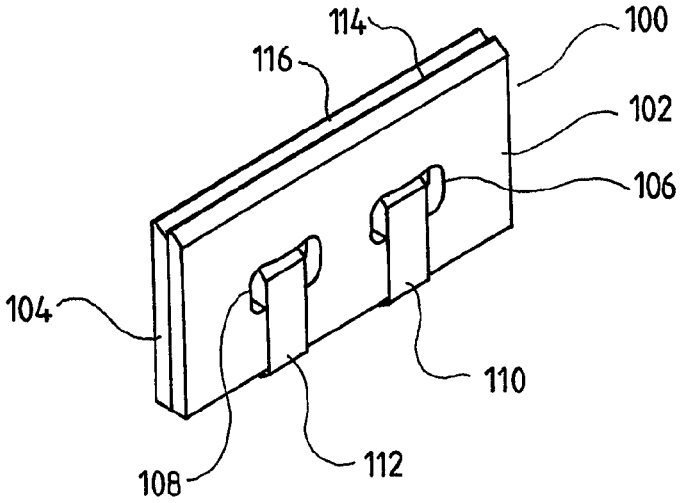
FIG. 10 shows a vane that is similar to that shown in FIG. 7, but with the main vane being formed by two smaller vanes positioned in face-to-face relationship.

As a further modification to the present invention, each vane may be formed by using two vanes placed in face-to-face contact. For example, two thinner vanes may be used instead of one vane. An example is shown in FIG. 10. In FIG. 10, the vane 100 includes a first vane 102 and a second vane 104. Vane 102 and vane 104 are positioned in face-to-face relationship with each other. Each of the vanes 102, 104 are provided with cut-outs 106, 108 and intravanes 110, 112. In this regard, the cut-outs and intravanes are largely as described with reference to FIG. 7.

Vane 102 and 104 are able to slide relative to each other.

During operation, the tip 114 of vane 102 comes into contact with the cam ring of the pump body (in normal operation, a fill of oil will be located between the tip and the cam rings) and the tip 116 of vane 104 also comes into contact with the cam ring. Thus, forces acting on the vane are distributed along two lines of contact (being the lines of contact formed by tips 114 and 116). Thus, the force acting on each tip is generally half the force that would act along a tip of a "single vane" vane. Consequently, wear of the vane is lowered.

As a further modification of the pump in accordance with the present invention, the vanes may be selectively retained in the retracted position, as described in my co-pending International patent application no PCT/AU2004/00951.

Figure 11:
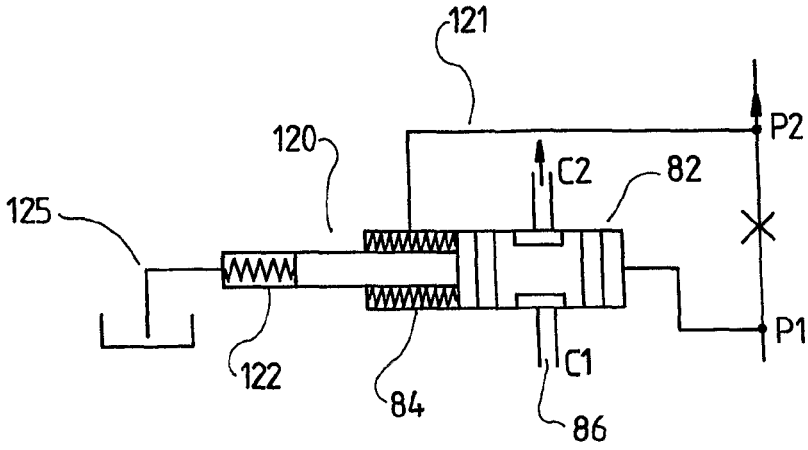
FIG. 11 is a schematic view of another hydraulic circuit that may be used in an embodiment of the present invention.
Figure 12:
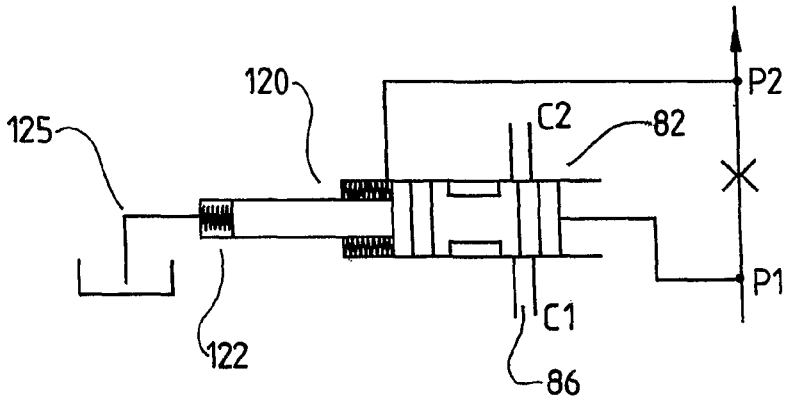
FIG. 12 is a schematic view of the hydraulic circuit shown in FIG. 11, with the control spool being in a closed position.

A modified version of the embodiment of the hydraulic circuit shown in FIG. 9 is shown with reference to FIGS. 11 and 12. The embodiment shown in FIG. 9 allows for enhanced vane stability as a function of pump speed. The embodiment shown in FIGS. 11 and 12 ensures that not only does the pump have sufficient speed to provide vane stability but also the outlet pressure of the pump is high enough to provide vane stability, such as in very cold start-up conditions in which the oil is very thick or viscous.

The embodiment shown in FIGS. 11 and 12 has a number of features in common with the hydraulic circuit shown in the embodiment of FIG. 9 and for convenience, like reference numerals will be used to refer to like parts. As shown in FIG. 11, oil is able to pass from the chamber C1 to chamber C2 until the pressure drop from P1 to P2 reaches a sufficient pressure drop equal to the spring force of spring 84. At this time the spool moved to the left and closes, shutting off the flow of oil from chamber C1 to C2, thereby stopping the flow of oil through passage 86. This shuts off the flow of oil to intra-vane 68. This essentially describes the operation of the hydraulic circuit shown in FIG. 9.

In the embodiment shown in FIGS. 11 and 12, a second spool 120 and spring 122 are added to prevent spool 82 from moving to the left to allow the flow from chamber C1 to C2 to be shut until system pressure is high enough to allow the second spool 120 to overcome the spring 122, ensuring both speed and outlet pressure stability. In this regard, the second spool 120 is subject to pressure P2 by virtue of oil line 121. When the pressure P2 is sufficiently large to overcome spring at 122, spool 120 moves to the left. When spool 120 is in the position shown in FIG. 11, the first spool 82 is prevented from closing, even if the pressure drop across the office reaches a level that would be sufficient to overcome the spring 84. Thus, in instances where the pressure being generated by the motor is low (for example, where the oil is cold), the first spool 82 remains open, thereby maintaining supply of oil to both intravanes and ensuring pump stability.

When the pressure P2 is sufficient to overcome spring 122, spool 120 moves to the left to the position shown in FIG. 12. In these circumstances, when the pressure drop across the orifice is sufficiently large, the first spool 82 can move to the left, to thereby close the supply of oil to one of the intravane regions.

In FIGS. 11 and 12, line 125 goes to drain or to the inlet of the pump.

Figure 13:
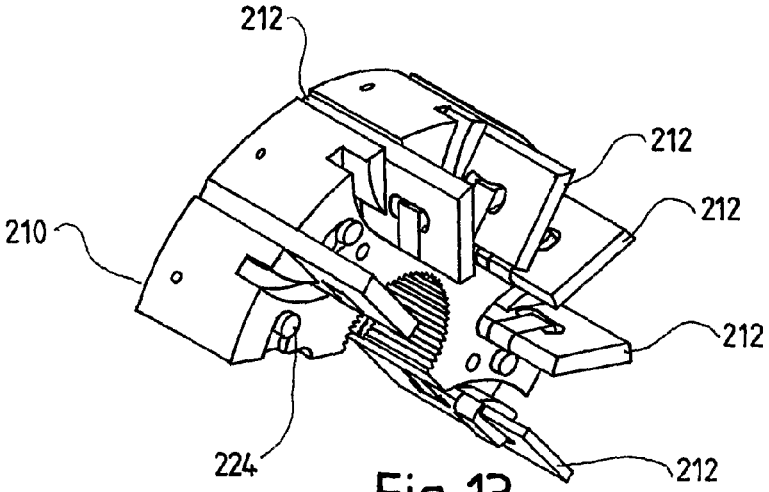
FIG. 13 is a perspective view of part of a rotor used in a hydraulic motor in accordance with another embodiment of the present invention.
Figure 14:
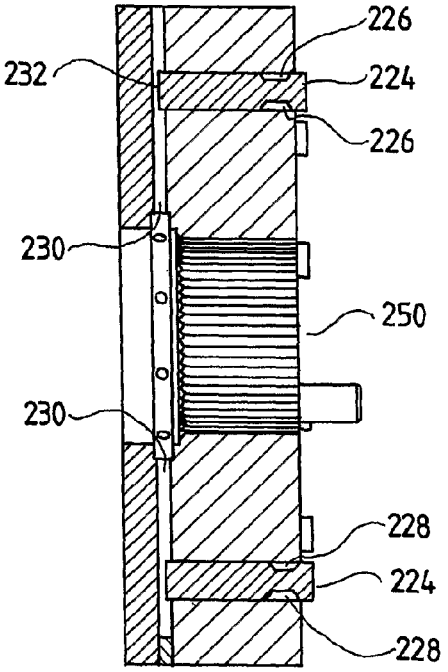
FIG. 14 is a cross-sectional side view of part of the rotor shown in FIG. 13.
Figure 15:
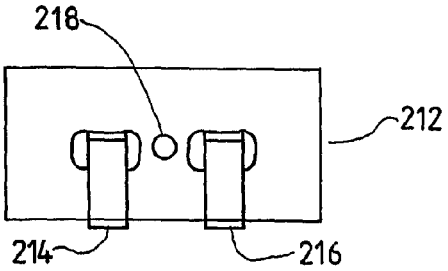
FIG. 15 is a side view of a vane used in the hydraulic motor shown in FIG. 13.

FIGS. 13, 14 and 15 show various views of a rotor and a vane of an embodiment of the present invention but modified to enable the vane to be selectively retained in the retracted position, in accordance with the disclosure of my International patent application number PCT/AU 2004/000951. In FIGS. 13 to 15, the rotor comprises two halves, one of which is shown at 210, that are dowelled and screwed together. The rotor includes a plurality of slots, each of which is fitted with a double intra-vane vane 212. FIG. 15 shows a side view of one of the vanes 212. As can be seen, it is provided with two intravanes 214, 216. In this regard, the vane 212 is generally similar to vane 60 as shown in FIG. 7. However, the vane 212 also includes a ball bearing groove 218 that can receive a ball bearing to retain the vane in a retracted position.

Returning now to FIG. 13, the rotor half 210 includes under vane oil supply passages 220. Although not clearly shown in FIG. 13, the rotor half 210 also includes oil supply passages for supplying oil to underneath the intravanes.

The rotor 210 is also provided with a plurality of spools 224. As shown in FIG. 13, spools 224 are mounted in passages formed in the rotor. The spool 224 includes tapered recessed regions 226. Ball bearings 228 (see FIG. 13) are positioned in tapered recessed regions 226. Each spool 224 is associated with an oil passage 230 that comes into register with pressurised oil as the rotor rotates. When the oil is of a sufficiently high pressure, it acts on the end 232 of spool 224 to move the spool 224 to the right (all directions are given with reference to the directions shown in FIG. 14). This causes the ball bearings to move up the sloping shoulders of the tapered recess regions 226 which, in turn, forces the ball bearings to enter the ball bearing groove 218 in the vane 212. In this fashion, the vane 212 can be selectively held in the retracted position.

Figure 16:
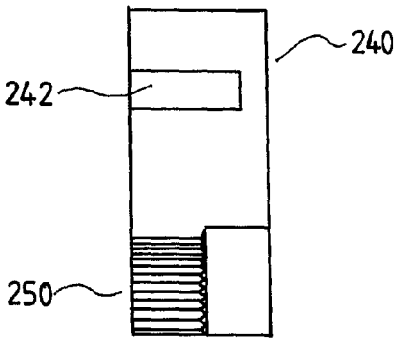
FIG. 16 is a cross-sectional view of part of another part of the rotor used in the point that shown in FIG. 13.

A portion of the second rotor half, which is joined to the first rotor half 210, is shown in FIG. 16. In FIG. 16, the second rotor half 240 has a passage 242 that can receive the right hand end of spool 224. This allows for reciprocating motion of the spool.

The pilot spool can return to the neutral position shown in FIG. 14 by use of an oil pilot signal, an appropriate spring or by centrifugal force.

Both the first rotor half 210 and the second rotor half 240 include region 254 receiving a splined drive shaft, in accordance with conventional practice.

Those skilled in the art will appreciate that the present invention may be subject to variations and modifications other than those specifically described. It will be understood that the present invention encompasses all such variations and modifications that fall within its spirit and scope.

The invention claimed is:

1. A vane pump for pumping hydraulic fluid comprising: a body having a chamber; and a rotor rotatable within the chamber, the chamber and the rotor being shaped to define one or more rise, fall and dwell regions between walls of the chamber and the rotor, the rotor having a plurality of slots, a plurality of vanes, with each slot of the rotor having a vane of the plurality of vanes located therein, each vane being moveable between a retracted position and an extended position~ with each vane having two intravanes disposed therein, wherein in the retracted position the vanes do not work the hydraulic fluid and in the extended position the vanes work the hydraulic fluid, wherein the chamber defines one or more inlets for introducing relatively low pressure hydraulic fluid, at an inlet pressure, into the one or more rise regions, and wherein the chamber defines one or more outlets for discharging relatively high pressure hydraulic fluid, at an outlet pressure, from the one or more fall regions, wherein the rotor defines an under vane passage extending beneath each vane with the vane resisting fluid flow between the under vane passage and the chamber through the vane, and a plurality of flow passages, each to communicate pressurized hydraulic fluid to a portion of an under vane passage, wherein each vane has disposed therein at least two intravanes located below an upper surface of the vane, and the rotor defines respective flow passages of the plurality of flow passages, each in fluid communication with a respective under vane passage to communicate pressurized hydraulic fluid to the intravanes, wherein in a first mode of operation pressurized hydraulic fluid is delivered to both intravanes regions of a vane when the pump is operating at a relatively low pump speed, and in a second mode of operation pressurized hydraulic fluid is delivered to one intravane of the vane when the pump is operating at a relatively high pump speed.

2. The vane pump as claimed in claim 1, wherein the pressurized hydraulic fluid to be delivered to an intravane is at between the inlet pressure of the pump and the outlet pressure of the pump.

3. The vane pump as claimed in claim 1, further comprising flow control means to pass hydraulic fluid to respective intravanes of a vane when the pump is operating at low pump speed and to pass hydraulic fluid to one of the respective intravanes when the pump is operating at high pump speeds.

4. A vane pump as claimed in claim 3, wherein the flow control means comprises a flow valve configured to be responsive to pump outlet flow, with the flow valve configured to resist a flow of hydraulic fluid to one of the intravanes of a vane at high pump speeds, and to allow the flow of hydraulic fluid to the one of the intravanes at high pump speeds.

5. A vane pump as claimed in claim 3, wherein the flow control means comprises a control valve that is configured to respond directly to pump speed.

6. A vane pump for pumping hydraulic fluid comprising a body having a chamber and a rotor rotatable within the chamber, the chamber and the rotor being shaped to define one or more rise, fall and dwell regions between walls of the chamber and the rotor, the rotor having a plurality of slots, each slot of the rotor having a vane located therein, each vane being moveable between a retracted position and an extended position wherein in the retracted position the vanes do not work the hydraulic fluid and in the extended position the vanes work the hydraulic fluid, one or more inlets for introducing relatively low pressure hydraulic fluid into the one or more rise regions and one or more outlets for discharging relatively high pressure hydraulic fluid from the one or more fall regions, an under vane passage extending beneath each vane, at least one flow passage for supplying pressurized hydraulic fluid to the under vane passages, each vane having at least two regions located below an upper surface of the vane, and flow passages for delivering pressurized hydraulic fluid to one or more of the at least two regions, wherein pressurized hydraulic fluid is delivered to both regions of a vane when the pump is operating at relatively low pump speeds, but delivered to only one region of a vane when the pump is operating at relatively high pump speeds, the pump including a control valve that is directly responsive to pump speed to control a flow of hydraulic fluid, wherein the pump is provided with a speed sensor and the speed sensor is configured to send a signal to the control valve and the control valve is configured to be controlled by a control algorithm to switch the valve from allowing flow to both regions of a vane to allowing flow to one region of the vane when the speed sensor detects that the pump speed has passed a predetermined threshold value.

7. A vane pump as claimed in claim 6, wherein the pump is arranged such that pressurized hydraulic fluid at pump outlet pressure is supplied to the undervane passage when the vanes are in a fall region and pressurized hydraulic fluid is supplied to one or both of the regions of a vane when the vane is in a rise region.

8. A vane pump as claimed in claim 7, wherein at low pump speeds, oil is provided to both regions of a vane and at higher pump speeds pressurized oil is supplied to only one of the regions.

9. A method for operating a vane pump of the intravane type for pumping hydraulic fluid, wherein each vane has two intravanes, each intravane positioned in a respective intravane region on respective sides of the pump, which method comprises: providing pressurized hydraulic fluid to both of the two intravanes at low pump speeds; and providing pressurized hydraulic fluid to only one intravanes of the two intravanes at high pump speeds, wherein for each vane of the pump, hydraulic fluid is restricted from flowing between an under vane region and a chamber of the pump through the vane.

10. A system, comprising: a pump housing; a vane pump rotating group rotatably disposed in the pump housing, the vane pump rotating group including: a block; and a plurality of vanes, with each of the vanes including two intravanes, one on a first side of the pump, and a second on a second side of the pump, wherein the block defines respective passages extending to a bottom of each intravanes, with a first set of passages on the first side in fluid communication with one another, and a second set of passages on the second side in fluid communication with one another; and a valve to, in a first mode of operation, place the first set of passages in fluid communication with a hydraulic signal to raise intravanes on the first side of the pump, and to, in a second mode of operation, place the second set of passages in fluid communication with the hydraulic signal to raise intravanes on both sides of the pump.

11. The system of claim 10, wherein the valve is configured to receive an electronic signal, and responsive thereto, switch between the first mode of operation and the second mode of operation.

12. The system of claim 10, wherein an intravane has a width, extending from the first side of the pump toward the second side of the pump, that is of greater magnitude than a thickness orthogonal to the width.

* * * * *

UNITED STATES PATENT AND TRADEMARK OFFICE

CERTIFICATE OF CORRECTION

PATENT NO. : 8,708,679 B2
APPLICATION NO. : 12/303224
DATED : April 29, 2014
INVENTOR(S) : Norman Ian Mathers It is certified that error appears in the above-identified patent and that said Letters Patent is hereby corrected as shown below:

On the Title page, in column 2, under "Foreign Patent Documents", line 3, after "1/2005", insert --¶DE 112007001338 T5 4/2009
JP 2005 351117 A 12/2005
JP 2009 539006 A 11/2009
JP 52 00009 A 2/2013
JP 53 22204 U 2/1978
JP 55 112085 U 8/1980--, therefor On the Title page 2, in column 2, under "Other Publications", line 2, after "2007.", insert --"¶Japanese Application Serial No. 2009-512374, Notice of Allowance mailed Jan. 15, 2013", 6 pgs.
"Japanese Application Serial No. 2009-512374, Office Action mailed May 08, 2012", (w/English Translation), 4 pgs.
"Japanese Application Serial No. 2009-512374, Response filed Aug. 03, 2012 to Office Action mailed May 08, 2012", (w/English Translation of Claims), 7 pgs.--, therefor

IN THE CLAIMS:

In column 11, line 44, in Claim 1, delete "position~" and insert --position,--, therefor In column 11, line 65, in Claim 1, after "intravanes", delete "regions", therefor In column 13, line 2, in Claim 9, delete "intravanes" and insert --intravane--, therefor In column 13, line 12, in Claim 10, delete "intravanes," and insert --intravane,--, therefor Signed and Sealed this
Twenty-third Day of December, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,708,679 B2
APPLICATION NO. : 12/303224
DATED : April 29, 2014
INVENTOR(S) : Norman Ian Mathers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1228 days.

Signed and Sealed this
Twenty-ninth Day of September, 2015

Michelle K. Lee

Michelle K. Lee
*Director of the United States Patent and Trademark Office*